US009566207B1

(12) United States Patent
Ratliff

(10) Patent No.: US 9,566,207 B1
(45) Date of Patent: Feb. 14, 2017

(54) HI-RISE WALKER

(71) Applicant: Maxine Ratliff, Sherwood, AR (US)

(72) Inventor: Maxine Ratliff, Sherwood, AR (US)

( * ) Notice: Subject to any disclaimer, the term of this patent is extended or adjusted under 35 U.S.C. 154(b) by 0 days.

(21) Appl. No.: 15/146,530

(22) Filed: May 4, 2016

(51) Int. Cl.
*A61H 3/04* (2006.01)
*A61H 3/00* (2006.01)

(52) U.S. Cl.
CPC ..... *A61H 3/04* (2013.01); *A61H 2003/006* (2013.01); *A61H 2003/046* (2013.01)

(58) Field of Classification Search
CPC ..... A61H 2003/006; A61H 2003/046
USPC ..... 280/87.021, 87.05; 135/67, 75
See application file for complete search history.

(56) References Cited

U.S. PATENT DOCUMENTS 3,394,933 A * 7/1968 Benoit ..... A61G 7/1019 254/4 R
4,510,956 A * 4/1985 King ..... A61H 3/04 135/67
5,020,560 A * 6/1991 Turbeville ..... A61H 3/04 135/67
5,676,388 A * 10/1997 Bertani ..... A61H 3/04 280/250.1
6,099,002 A * 8/2000 Uchiyama ..... A61H 3/04 135/67
6,340,168 B1 * 1/2002 Woleen ..... A61G 5/08 135/66
6,733,018 B2 * 5/2004 Razon ..... A61H 3/008 135/67
6,974,142 B1 * 12/2005 Shikinami ..... A61H 3/04 280/250.1
7,111,856 B1 * 9/2006 Graham ..... A61H 3/04 135/67
7,275,554 B2 * 10/2007 Mullholand ..... A61H 3/008 135/67
7,377,285 B2 * 5/2008 Karasin ..... A61H 3/04 135/66
7,481,445 B1 * 1/2009 Danziger ..... A61G 5/08 280/250.1
7,494,138 B2 * 2/2009 Graham ..... A61G 5/08 280/304.5
7,669,863 B2 * 3/2010 Steiner ..... A61G 5/14 280/250.1
7,866,677 B1 * 1/2011 Rothstein ..... A61H 3/04 135/67
7,992,584 B1 * 8/2011 Birnbaum ..... A61H 3/04 135/67
8,151,812 B2 * 4/2012 Razon ..... A61H 3/04 135/66
8,215,652 B2 * 7/2012 Dashew ..... A61H 3/04 135/67
8,540,256 B1 * 9/2013 Simpson ..... A61H 3/00 135/67
8,770,212 B2 * 7/2014 Alghazi ..... A61G 7/10 135/66
9,016,297 B2 * 4/2015 Salomon ..... A45B 1/02 135/66

(Continued)

*Primary Examiner* — Jeffrey J Restifo
(74) *Attorney, Agent, or Firm* — Egbert Law Offices, PLLC

(57) ABSTRACT

A walker assists a user to walk, sit down, and stand up from a sitting position. The walker includes a set of side frames, a connection bar, and a set of arm rests. The walker also includes a brake assembly for wheel assembly connected to front portion of both side frames to prevent any movement of the walker as the user attempts to achieve an upright position.

20 Claims, 8 Drawing Sheets

(56) References Cited

U.S. PATENT DOCUMENTS

| | | | | |
|---|---|---|---|---|
| 9,149,408 | B2 * | 10/2015 | Karlovich | A63B 69/0064 |
| 9,180,064 | B2 * | 11/2015 | Prather | A61H 3/04 |
| 9,198,823 | B1 * | 12/2015 | Whited | A61H 3/04 |
| 9,314,395 | B1 * | 4/2016 | VanAusdall | A61H 3/04 |
| 2003/0137119 | A1 * | 7/2003 | Razon | A61H 3/008 280/87.021 |
| 2005/0076939 | A1 * | 4/2005 | Karasin | A61H 3/04 135/67 |
| 2005/0156395 | A1 * | 7/2005 | Bohn | A61H 3/04 280/87.021 |
| 2007/0199586 | A1 * | 8/2007 | Cheng | A61H 3/04 135/67 |
| 2009/0033052 | A1 * | 2/2009 | Bradshaw | A61H 3/04 280/87.021 |
| 2009/0224499 | A1 * | 9/2009 | Dashew | A61H 3/04 280/87.05 |
| 2013/0319488 | A1 * | 12/2013 | Chiu | A61H 3/00 135/67 |
| 2015/0216757 | A1 * | 8/2015 | Powell | A61H 3/04 280/657 |

* cited by examiner

HI-RISE WALKER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates generally to a walker. More specifically, the present invention is a walker that assists a user when attempting to stand up from a sitting position in a safe manner.

2. Description of Related Art Including Information Disclosed Under 37 CFR 1.97 and 37 CFR 1.98.

Traditional walkers comprise a variety of features that are meant to assist and protect an individual when walking A few standard features include rubber handles, rubber bases, wheels and a brake system. These features help an individual when walking, however plenty of accidents occur not only when walking, but during the process of standing up. Traditional walkers do not provide the necessary support for a safe uplift. Some, in fact do not even have the necessary components that prevent the walker from slipping forward when the user is leaning on the walker and relying on the walker when trying to stand up.

A number of different types of walkers are present in prior art. For example, see: U.S. patent application Ser. No. 10/760,908 to David; U.S. Pat. No. 6,340,168 to Norman; U.S. Pat. No. 6,733,018 to Eli; U.S. Pat. No. 7,377,285 to Karasin et al; U.S. Pat. No. 7,481,445 to Robert; U.S. Pat. No. 7,669,863 to Steiner et al; U.S. Pat. No. 8,151,812 to Eli; U.S. Pat. No. 8,215,652 to Dashew et al; U.S. Pat. No. 8,540,256 to Thomas.

Prior art, U.S. Pat. No. 7,377,285 discloses a walker having two sets of handles positioned for rising from and lowering to a seated position in addition to serving as a walking aid. The walker comprises a frame having a front section comprising a pair of front vertical supports and a rigid cross-piece, and two side sections each comprising a rear vertical support having a load-bearing axis formed through a ground-engaging point, rigid connectors connecting the side sections to the front section, a first pair of handles positioned to support a user in a standing or walking position, and a second pair of handles positioned below and to the rear of the first set of handles to support a user in rising from or lowering to a seated position, in which the geometric centers of each of the second pair of handles is positioned to the rear of the load-bearing axis of each of the rear vertical supports.

Another prior art, U.S. Pat. No. 8,215,652 discloses a mobilizer that consists of an open, inverted "U" shaped frame when viewed from above with the legs or the "U" pointed towards the rear. Pivoting caster wheels are attached to the front lower corners and rear wheel support arms extend rearward and curve downward each bearing a smaller non-pivoting wheel. Two vertical upright support members rise from the frame and are equipped with height adjustment mechanisms. Horizontal arm support assemblies, each with a hand grip and brake handle are attached to the upper ends of the support members. The user is supported by his elbows and shoulder girdle resulting in decompression of his spine. The arm support assemblies can be pivoted 180 degrees so that the grip portions and the hand brake levers face the rear of the mobilizer at about waist height. This allows the user to stand and grasp the handles as he walks forward.

Another prior art, U.S. patent application Ser. No. 10/760,908 discloses a pair of arm rest platforms and vertical handles so the user of a rolling walker can have added or alternate support not provided by a conventional rolling walker or rollator. The arm rest platforms are supported at a vertical distance above the conventional walker by providing a pair of arm rest frames each extending between the main frame of the conventional walker and a respective arm rest platform. The arm rest frames each includes an main arm rest frame member carried by the main frame of the conventional walker and an arm rest support member to carry the arm rest platform and vertical handles. The conventional hand brakes can also be relocated; to be operated when gripping the vertical handles. The arm rest platforms can be adjusted in both horizontally and vertically with respect to the main frame of the conventional walker for better distribution of the user's weight.

The present invention serves to eliminate any deficiencies of traditional walkers. The present invention comprises a couple of side frames, a connection bar, and a couple of arm rests. The couple of side frames supports the user and eases the movement of the user with a wheel mechanism which includes a brake assembly. The connection frame is meant to connect the couple of side frames. Alternate embodiments of the connection frame may collapse for more convenient storage. The couple of arm rests are fixed to the couple of side frames in order to provide support and stability to the user's forearm when attempting to stand up. The preferred use of the present invention is to engage the brake assembly when attempting to stand up.

BRIEF SUMMARY OF THE INVENTION

In the view of the foregoing disadvantages inherent in the known types of walkers now present in the prior art, the present invention provides an improved walker. As such, the general purpose of the present invention, which will be described subsequently in greater detail, is to provide a new and improved walker which has all the advantages of the prior art and none of the disadvantages.

An object of the invention is to provide a walker that assists a user when attempting to stand up from a sitting position in a safely manner.

It is another object of the present invention to provide a walker comprises a couple of side frames, a connection bar, and a couple of arm rests.

It is another object of the present invention to provide a walker that also comprises a brake assembly for both couple side frames to prevent any movement of the walker as the user attempts to achieve an upright position.

It is another object of the present invention to provide walker that helps user to walk upright and take pressure off hands.

It is another object of the present invention to provide walker that consists of a plurality of separable pieces.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

All illustrations of the drawings are for the purpose of describing selected versions of the present invention and are not intended to limit the scope of the present invention.

DETAILED DESCRIPTION OF THE INVENTION

Figure 1:
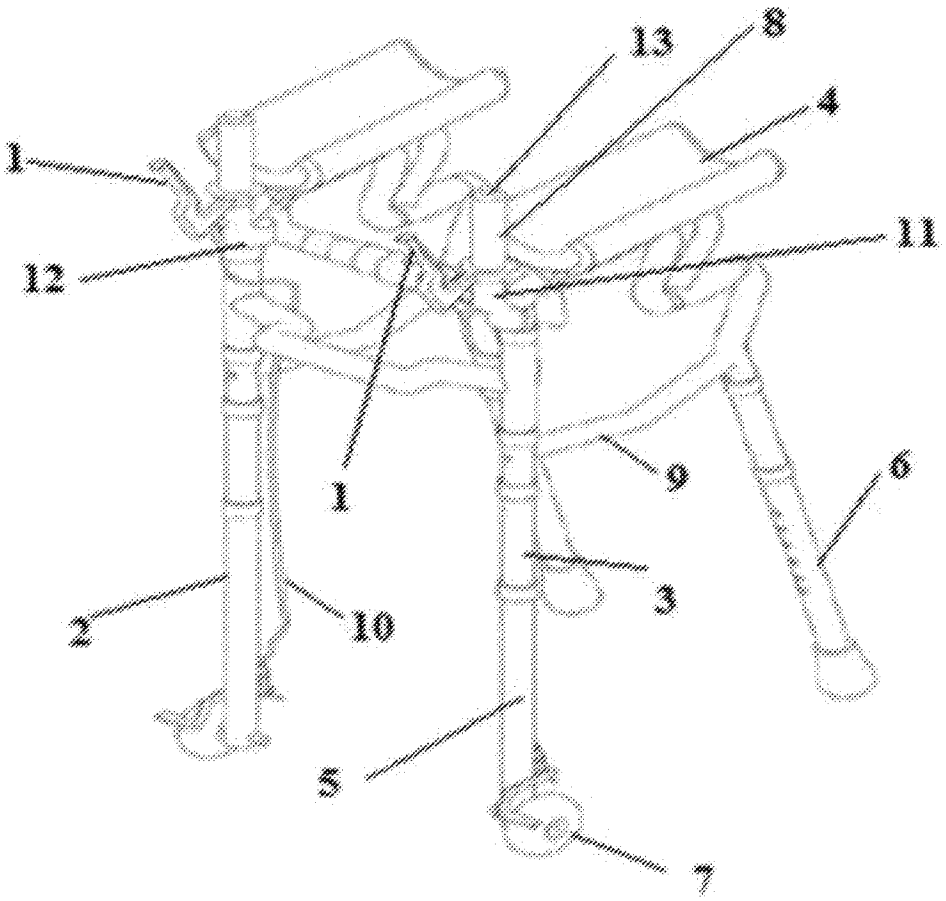
FIG. 1 is a perspective view of the present invention.

The present invention comprises a couple of side frames, a connection bar, and a couple of arm rests. The preferred embodiment of the walker is a singular entity, whereas an alternate embodiment may comprise a plurality of separable pieces. Referring to FIG. 1 the walker comprises a brake 1 assembly for both couple side frames 2 to prevent any movement of the walker as the user is attempting to achieve an upright position.

The couple of side frames each comprises a couple of legs 3, a stabilizing bar, and an arm 4. The couple of legs comprises a front leg 5 and a back leg 6. The front leg and back leg are connected via the stabilizing bar 9 and arm. The arm is the connection between the top faces of both the front leg and the back leg. The stabilizing bar protrudes from the inner side of both the front leg and back leg. The front leg and back leg are vertical rods that angle slightly inwards towards each other. The couple of legs along the left side of the present invention is parallel to the couple of legs along the right side of the present invention.

The front leg comprises a wheel mechanism 7 and a grip 8. The wheel mechanism comprises a wheel assembly and a brake assembly. The wheel assembly is fixed to the bottom of the front leg in the same manner as wheel assemblies are attached to the traditional walkers. The wheel assembly comprises components similar to that of traditional wheel assembly of walkers such as a wheel, a rim, and an axle. The brake assembly is connected to the wheel assembly so that the user may control the position of the present invention and in a similar manner as that of the brake assembly of traditional walkers. The brake assembly comprises similar components as well, such as a brake handle and a brake cable 10 and any other components in traditional disc brake hardware. The brake handle is fixed to the grip. The grip comprises an extension 11, a base, a platform, and a handle. The extension is a plate that protrudes from the front portion of the arm. The extension is a plate that encompasses a portion of the arm. The base is a rod that extends from the front face of the extension plate and is parallel to the front leg. The platform is a thin disk 12 that is concentrically fixed to the top face of the base. The handle 13 protrudes from the top planar surface of the platform. The handle is meant for the user to grasp when needed. The handle is a vertical cylinder preferably comprised a rubber covering 8.

Figure 2:
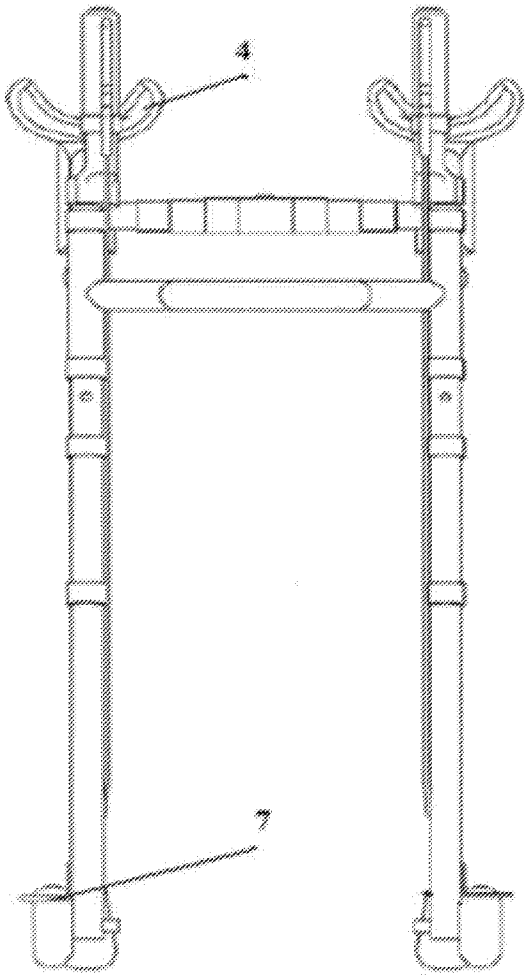
FIG. 2 is a front view of the present invention.
Figure 3:
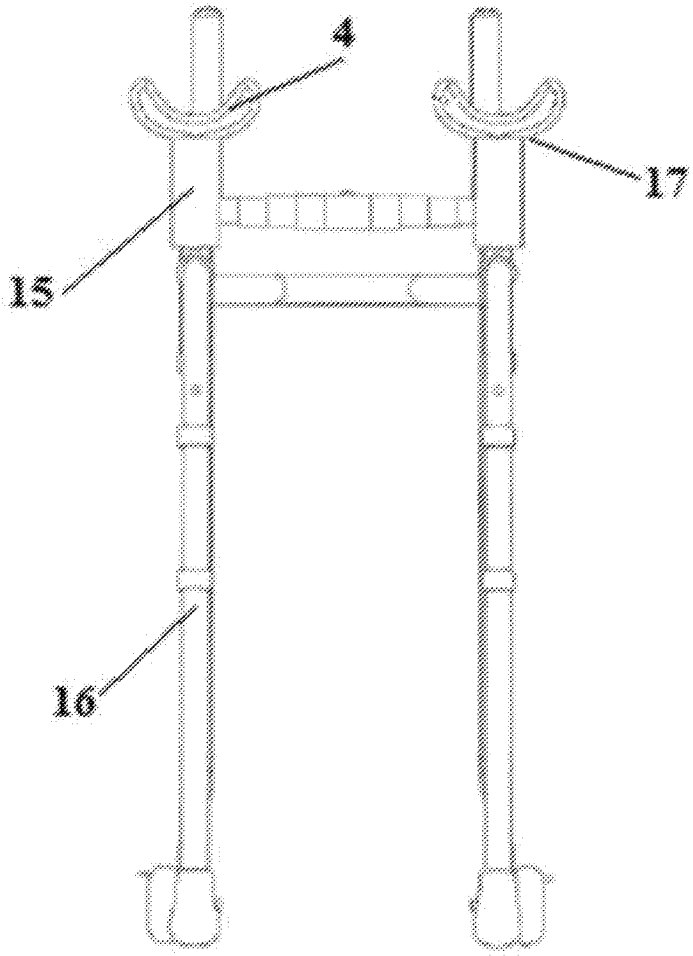
FIG. 3 is a rear view of the present invention.

The concave top surface is clearly illustrated in the front view of FIG. 2. The preferred embodiment comprises a padding, however alternate embodiments may comprise a bed without padding. The preferred embodiment of the present invention comprises a couple of arm rests 4 that comprise a removable couple of arm rests. The concave top surface is clearly illustrated in the rear view of FIG. 3. The couple of armrests 4 may comprise a base that snaps onto the arm of the couple of the side frames 16. An alternate embodiment of the arm rest may comprise a plurality of holes and requires a plurality of screws 17 to connect the base of the arm rest to arm of the side frame. Alternate embodiments of the present invention comprise a couple of arm rests that are permanently fixed to the couple of side frames.

Figure 4:
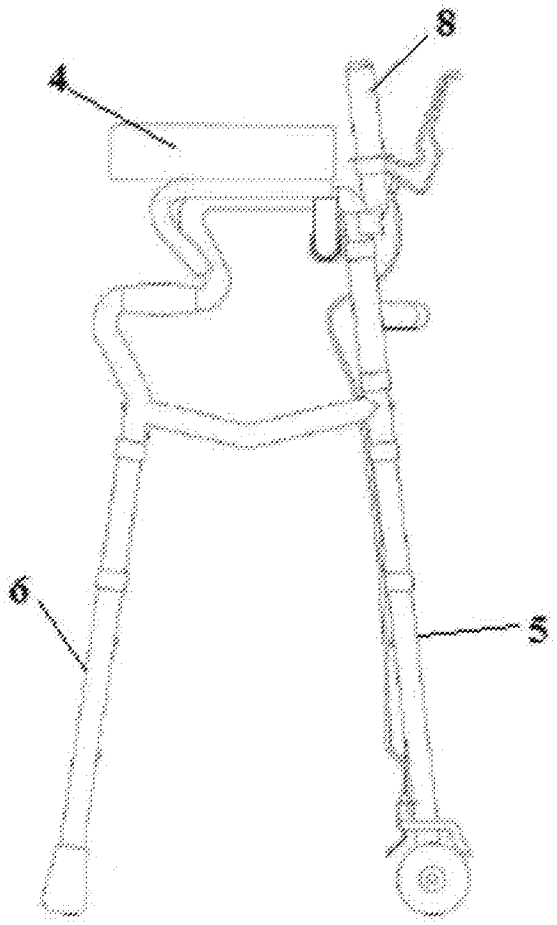
FIG. 4 is a left side view of the present invention.

The relationship of the arm with the couple of side frames is illustrated in the left side view of FIG. 4. The arm 4 is an extension of the front 5 and back leg 6 along the top which connects the front leg and back leg of the couple of side frames. The arm comprises an upper bar, a lower bar, and a couple of interconnecting bars. The upper bar is a certain distance higher than the lower bar and is connected to the lower bar via one of the interconnecting bars. The upper bar is the extension that extends directly from the front leg. The upper bar is a horizontal rod and is meant to provide a base structure for an arm rest. The lower bar is the extension that extends directly from the back leg. The lower bar is horizontal rod that comprises a handle grip 8. The handle grip is a padded area along the exterior of the lower bar.

Figure 5:
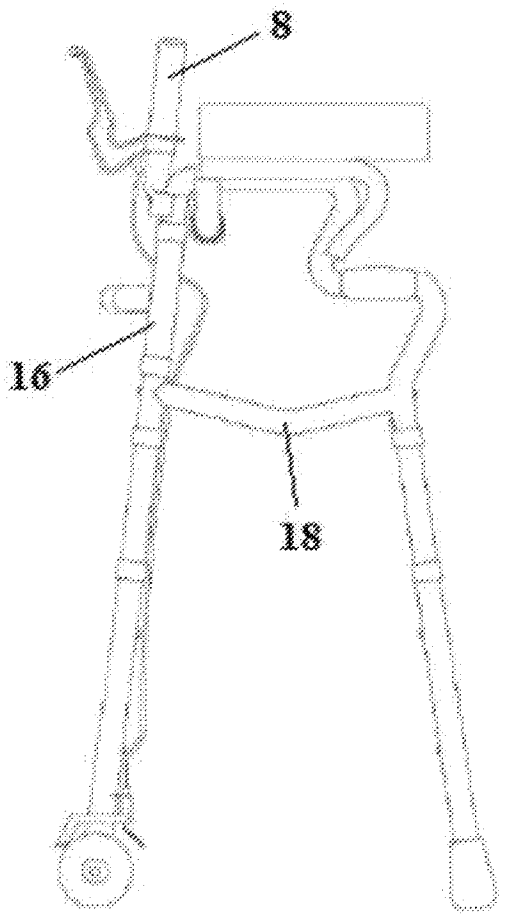
FIG. 5 is a right side view of the present invention.
Figure 6:
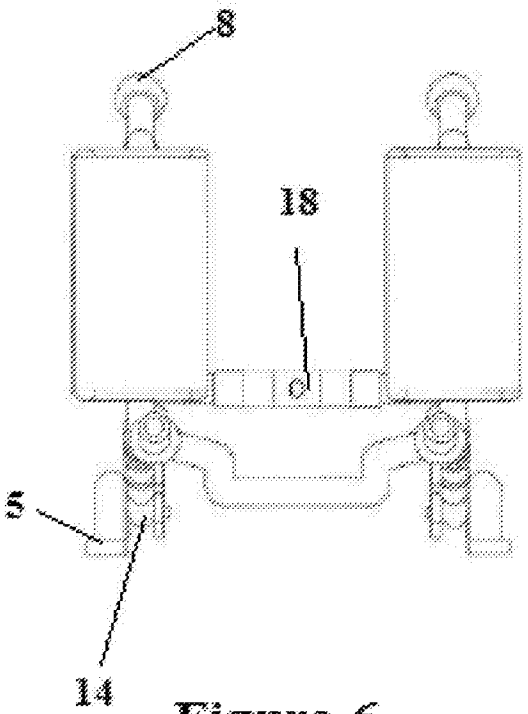
FIG. 6 is a top view of the present invention.
Figure 7:
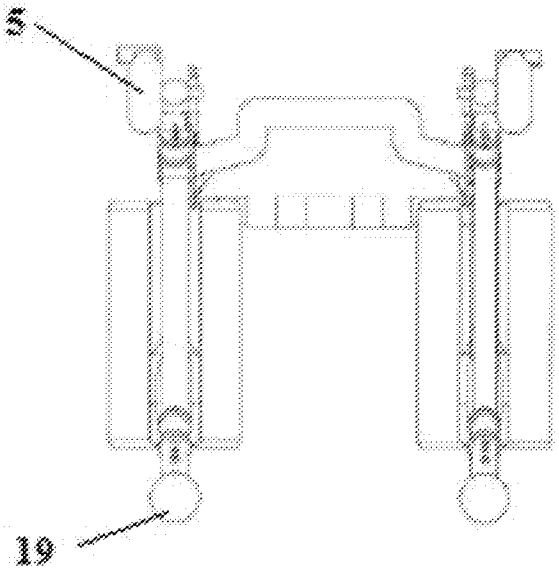
FIG. 7 is a bottom view of the present invention.

Referring to FIG. 5, the padded area comprises a rubber-like material that provides comfort to the user whenever the user may need to grip 8 and rest upon the handle grips of the couple of the side frames 16. The couple of interconnecting bars is the vertical connection that is between the upper and lower bars and the lower bar and back leg. The couple of interconnecting bars is the vertical extensions of the upper bar and lower bar. The connection bar is a horizontal bar 18 that connects the couple of side frames, shown in the top view of FIG. 6. The connection bar 18 comprises a similar ornamental design as the stabilizing bar of the couple of side frames. The back leg is a couple of telescopic rods 14 that comprise an inner rod and an outer rod. The inner rod comprises a couple of buttons that are used to adjust the length of the back leg. The couple of buttons comprises a covering and a spring similar to that of traditional walkers. The user is meant to push the couple of button inwards to release the position of the outer rod in order to adjust the length of the back leg. The spring is meant to extend the button into a notch of the outer rod. The couple of buttons protrudes through two of the plurality of notches of the outer rod as seen in FIG. 7. The outer rod is a hollow rod that surrounds the inner rod and comprises a plurality of notches and a rubber base 19. The plurality of notches is holes that align in a vertical manner and align with the position of the couple of buttons of the inner rod. The plurality of notches comprises dimensions that correspond to the dimensions of the couple of buttons. The rubber base is a rubber covering that surrounds the exterior base of the outer rod. The rubber base is similar to the rubber bases of traditional walkers. The rubber base is meant to provide friction with the ground when needed. Alternate embodiments may comprise a variety of rubber bases that better stop the walker from moving from its desired position.

The stabilizing bar is a horizontal rod that supports and connects the front and back leg. The preferred embodiment comprises a solid stabilizing bar that is fixed to the inner faces of the front and back leg. Alternate embodiments may comprise a stabilizing bar that is removable for easier storage.

Figure 8:
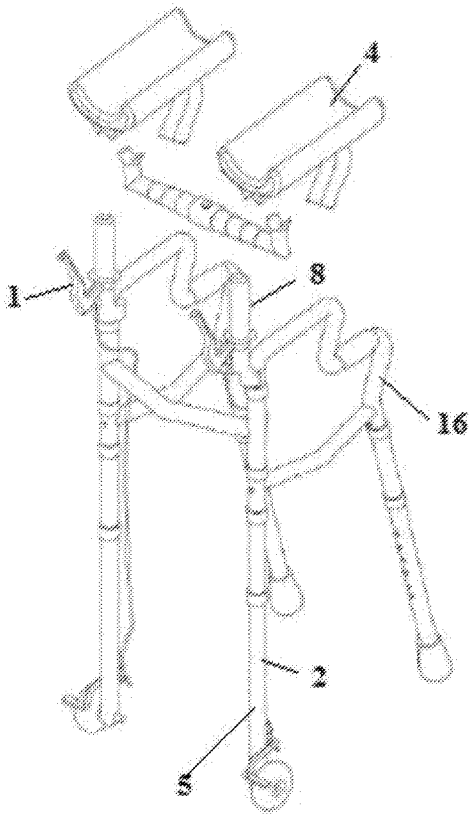
FIG. 8 is an exploded view of the present invention.

The preferred embodiment of the present invention comprises a connection bar that is fixed to the inner faces of the front legs of the couple of side frames. The connection bar is certain distance higher than both of the stabilizing bars of the couple of side frames. Alternate embodiments may comprise a connection bar that is collapsible for easier storage and transport. The couple of arm rests each connected to the upper bar and the interconnection bar between the upper bar and lower bar of the arm of each of the couple of side frames. The couple of arm rests are meant to provide stability and comfort to the user when attempting to stand up. The couple of arm rests each comprise a base and a bed. The base is the connection between the arm of the couple of side frames and the bed of the couple of arm rests. The base comprises a horizontal portion and a vertical portion. Both the horizontal portion and the vertical portion comprise a concave bottom face that comprises the same dimensions as that of the upper bar and interconnecting bar of the arm of the couple of side frames, seen in the exploded view of FIG. 8. Both the horizontal portion and a vertical portion both comprise a flat planar-like top face. The bed comprises a flat bottom surface and a concave top surface. The flat bottom surface is fixed to the flat top surface of the base. The concave top surface of the bed comprises dimensions that allow a user to insert his or her forearm between the side edges of the concave top surface.

The present invention is meant to assist a user when walking, sitting down, and standing up from a sitting position. In order to properly engage the present invention when walking, the user may hold onto the grips of the front legs 5 of the couple of side frames or the handle grips of the lower bar of the arm and proceed to walk while slightly leaning on the walker. In order to engage the present invention when in the process of sitting down from a standing position, the user must engage the brakes 1 via the brake handle of the brake assembly which activates the brake assembly in the same manner as traditional walkers do. When the brakes are fully engaged, the user may hold onto the grips 8 of the side frames 16 and proceed to sit down while pushing slightly onto the grips. In order to properly engage the present invention when in the process of standing up from a sitting position, the user must first engage the brake assembly in the same manner as when attempting to sit down. The user must then take his or her arms and place the forearms into the beds of the couple of arm rest 4 and grasp the grips of the front legs 5 of the couple of side frames. The user may then proceed to stand up from a sitting position. The bed of the arm rest supports the arm of the user and prevent the arm from moving and displacing throughout the entire process.

Although the invention has been explained in relation to its preferred embodiment, it is to be understood that many other possible modifications and variations can be made without departing from the spirit and scope of the invention.

It is to be understood that the above description is intended to be illustrative, and not restrictive. For example, the above-discussed embodiments may be used in combination with each other. Many other embodiments will be apparent to those of skill in the art upon reviewing the above description.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention.

I claim:

1. A walker, comprising:

a plurality of side frames wherein each frame comprises at least two legs, a stabilizing bar, and an arm; wherein the arm comprises an upper bar, a lower bar, and a plurality of interconnecting bars; wherein at least two legs comprise a back leg and a front leg; wherein the back leg comprises an inner telescopic rod and an outer telescopic rod; wherein the front leg comprises a wheel mechanism and a grip; wherein the wheel mechanism comprises a wheel assembly and a brake assembly, wherein the brake assembly comprises a brake handle, a brake cable, and a brake disk hardware, wherein the brake handle is fixed to said grip, wherein the grip comprises an extension, a base, a platform and a handle;

a connection bar fixed to an inner face of front legs of a plurality of side frames;

a plurality of arm rests wherein each arm rest comprises a base an a bed; wherein the base comprises a vertical portion and a horizontal portion and the bed comprises a flat bottom surface and a concave top surface.

2. The walker according to claim 1, wherein the front leg and the back leg are connected by the stabilizing bar.

3. The walker according to claim 1, wherein the stabilizing bar is a solid horizontal rod.

4. The walker according to claim 1, wherein the arm connects top faces of the front leg and back leg.

5. The walker according to claim 1, wherein the interconnecting bar connects the upper bar to the lower bar.

6. The walker according to claim 1, wherein the front leg is a vertical rod.

7. The walker according to claim 1, wherein the back leg is a vertical rod.

8. The walker according to claim 1, wherein the wheel assembly is fixed to the bottom of the front leg.

9. The walker according to claim 1, wherein the wheel assembly further comprises a wheel, a rim, and an axle.

10. The walker according to claim 1, wherein the brake assembly is connected to the wheel assembly.

11. The walker according to claim 1, wherein the extension is a plate protruding from the front portion of the arm.

12. The walker according to claim 1, wherein the base is a rod extending from a front face of the extension.

13. The walker according to claim 1, wherein the base runs parallel to the front leg.

14. The walker according to claim 1, wherein the platform is a thin disk, concentrically fixed to a top face of the base.

15. The walker according to claim 1, wherein the handle protrudes from the top planar surface of the platform.

16. The walker according to claim 1, wherein the inner telescopic rod further comprises a plurality of buttons.

17. The walker according to claim 16, wherein the length of the back leg is adjusted by said plurality of buttons.

18. The walker according to claim 1, wherein said plurality of arm rests is connected to the upper bar and the interconnecting bar.

19. The walker according to claim 1, wherein the plurality of arm rests is removable.

20. The walker according to claim 1, wherein the base connects the arm of the plurality of side frames and the bed of the plurality of arm rests.

* * * * *